US005307859A

United States Patent [19]

Kraeutler

[11] Patent Number: 5,307,859

[45] Date of Patent: May 3, 1994

[54] GOODS-HANDLING DOOR REDUCED SURFACE ABRASION

[75] Inventor: Bernard Kraeutler, Dunieres, France

[73] Assignee: Nergeco (société anonyme), Dunieres, France

[21] Appl. No.: 970,780

[22] Filed: Nov. 3, 1992

[30] Foreign Application Priority Data

Nov. 5, 1991 [FR] France ..... 91 13611

[51] Int. Cl.[5] ..... A47G 5/02

[52] U.S. Cl. ..... 160/264

[58] Field of Search ..... 160/264, 84.1, 23.1, 160/66, 120, 121.1, 238, 237, 265, 270, 271

[56] References Cited

U.S. PATENT DOCUMENTS

| | | | |
|---|---|---|---|
| 3,292,685 | 12/1966 | Clark | 160/264 |
| 3,583,465 | 6/1971 | Youngs et al. | 160/264 |
| 4,397,347 | 8/1983 | Brabant | 160/84.1 X |
| 4,736,785 | 4/1988 | Seuster | 160/264 |
| 4,800,946 | 1/1989 | Rosenoy | 160/264 |
| 4,824,505 | 4/1989 | Kraeutler | 160/84.1 X |
| 4,825,921 | 5/1989 | Rigter . | |
| 5,099,905 | 3/1992 | Rigter | 160/264 X |

FOREIGN PATENT DOCUMENTS

| | | |
|---|---|---|
| 0113634 | 12/1984 | European Pat. Off. . |
| 0194194 | 9/1986 | European Pat. Off. . |
| 8525625 | 9/1985 | Fed. Rep. of Germany . |

*Primary Examiner*—David M. Purol

*Attorney, Agent, or Firm*—Sughrue, Mion, Zinn, Macpeak & Seas

[57] ABSTRACT

A goods-handling door having a retractable curtain includes a flexible curtain that is rollable or foldable by use of a rotary winding shaft. In the door, the curtain is provided, on at least one face, with at least one flexible strip extending perpendicular to the shaft and forming excess thickness on the curtain. When the curtain is rolled or folded in its retracted position, the separation strip rolls or folds onto itself to hold the layers of the curtain apart from one another.

6 Claims, 3 Drawing Sheets

FIG.1
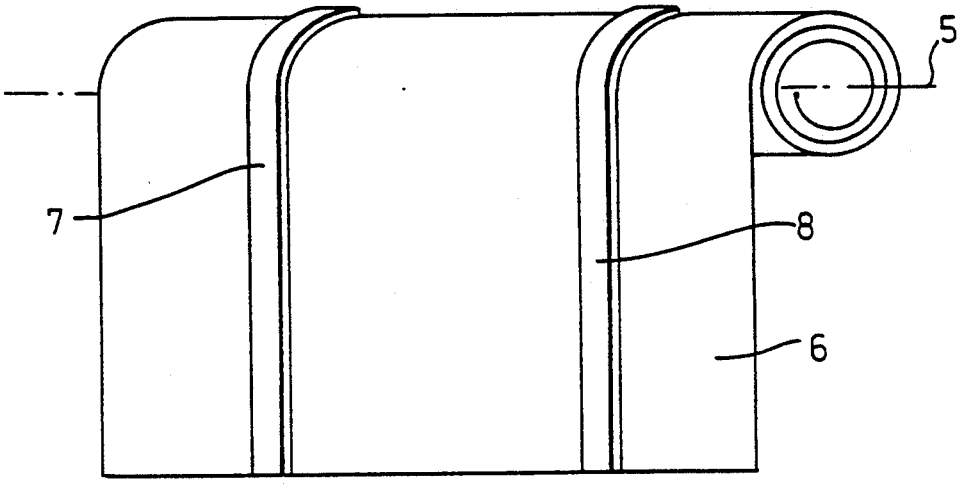
FIG.2
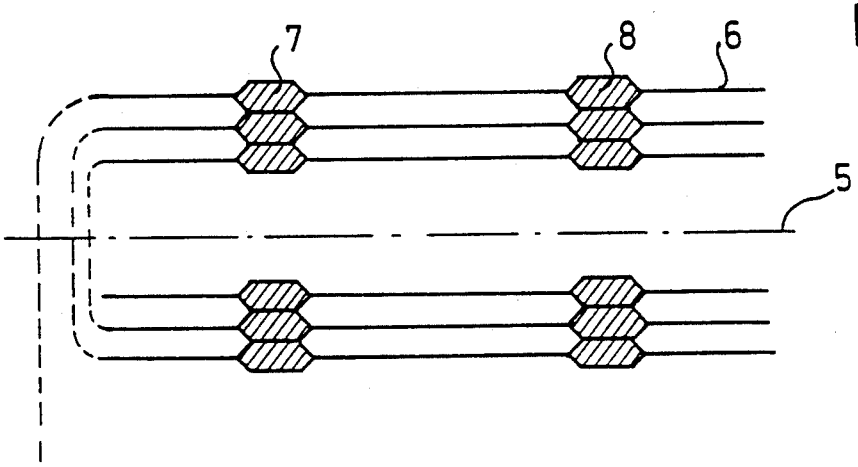
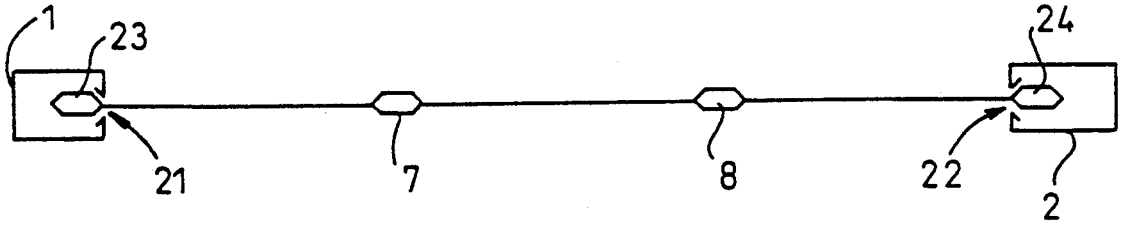
FIG.7

VII
2
4
9
V
V
8
3
IV
7
VI
VI
IV
1
VII

GOODS-HANDLING DOOR REDUCED SURFACE ABRASION

The present invention relates to doors, e.g. "goods-handling doors" including a curtain that can be raised or that can be retracted sideways.

BACKGROUND OF THE INVENTION

Doors are used in factories, warehouses, stores, garages, etc., to provide isolation against cold or noise, either from the outside or between adjacent premises. Such doors generally comprise a frame which in raisable doors, is constituted by two side uprights interconnected at their top ends by a horizontal cross-member, together with a curtain that is generally made of plastic and that is suitable for being raised quickly to open a passage through the door and which is collected together at the top of the door above the passage opened therethrough, either by being rolled up or else by being folded up concertina-like. The invention relates more particularly to doors that are transparent, at least in part. A vehicle, such as a truck or a handling carriage, etc., must be capable of passing through the door quickly. When a vehicle approaches, the curtain is automatically raised vertically or is automatically moved away sideways. Thus the vehicle can maintain speed as it goes through the door it is important that the driver of the vehicle see whether the space on the other side of the door is empty or whether another vehicle is arriving from the opposite direction.

When a curtain having a transparent portion is collected together at the top of the door or to the side thereof, the various different portions of the curtain can rub against one another. The surface of the curtain which is generally made of plastic is thus roughened rapidly, thereby reducing visibility therethrough.

Curtains are often reinforced by horizontal stiffening bars which serve to guide the curtain in slideways at the sides of the curtain. While a curtain is being wound up, such bars rub against the transparent portions of the curtain, thereby worsening the roughening effect. In addition, while a curtain is being wound up or down, whenever one of its bars engages already-wound portion of the curtain, or whenever it leaves that portion, considerable noise is generated which is detrimental to the surroundings.

SUMMARY OF THE INVENTION

The present invention provides a goods-handling door having a retractable curtain, in particular a raisable curtain. The door includes a flexible curtain that is rollable or foldable by means of a rotary winding shaft, wherein said curtain is provided on at least one face with at least one flexible strip extending perpendicularly to the shaft and forming excess thickness on the curtain, thereby constituting a separation strip such that when the curtain is rolled or folded, said strip rolls or folds onto itself, thereby holding the layers of the curtain apart from one another when the curtain is in its retracted position.

To clarify the explanation, an embodiment of the invention has been chosen in which the curtain is raisable. Naturally the invention also extends to curtains that are retracted in a direction other than the vertical, direction. The important point being that the separation strip should extend in the retraction direction, so as to be rolled or folded onto itself, thereby keeping the layers of the curtain apart from one another, and thus reducing friction and noise between them.

According to another feature of the invention, separation strips are also provided in at least one other direction, in particular a direction perpendicular to the first direction, i.e., parallel to the winding axis.

Advantageously, a separation strip parallel to the winding axis contains or forms a stiffening component for the curtain, in particular, a reinforcing bar.

According to an advantageous feature of the invention, separation strips are provided on the edges of the curtain. In an embodiment of the invention, separation strips are disposed on the edges of the curtain to form thick portions for retaining the edges of the curtain in the slideways.

BRIEF DESCRIPTION OF THE DRAWINGS

Embodiments of the invention are described by way of example with reference to the accompanying drawings, in which:

FIG. 1 is a diagrammatic front view of one example of a curtain of the invention that is partially rolled up;

FIG. 2 is a section view through the rolled-up portion of the curtain on a plane that includes its winding axis;

FIGS. 4, 5, 6, and 7 are section views of the curtain shown in FIG. 3, respectively on planes IV—IV, V—V, VI—VI, and VII—VII.

DETAILED DESCRIPTION

Figure 3:
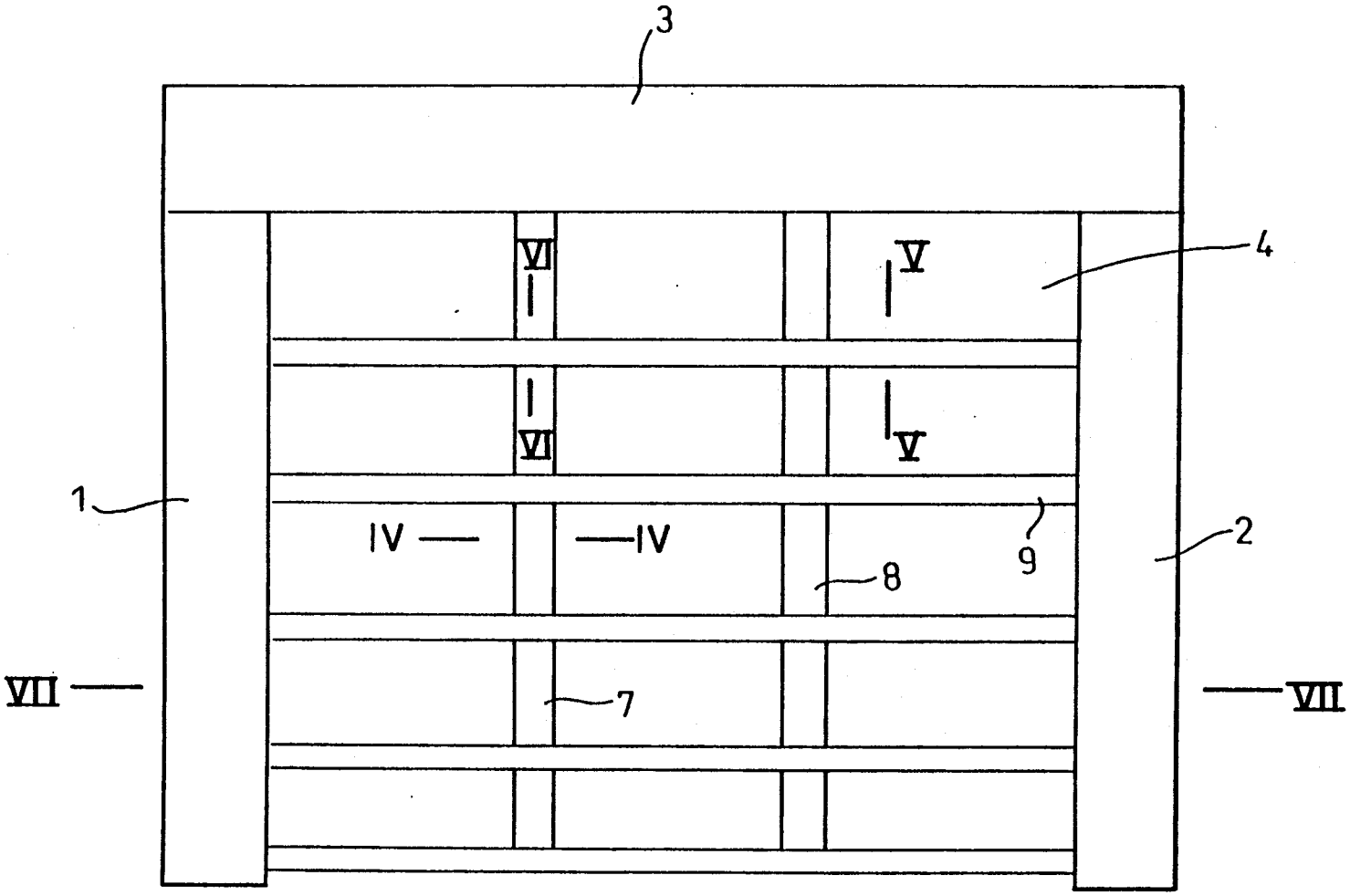
FIG. 3 is a front view of a goods-handling door of the invention fitted with a curtain constituting another embodiment of the invention.

An example of a door to which the invention applies is shown in FIG. 3. The door includes two side uprights 1 and 2 that form slideways for the edges of the curtain, and a top cross-member 3 that interconnects the top ends of the uprights. These uprights and cross-member are disposed around a door-bay which may either be closed or left open by means of a curtain 4, which curtain is suitable for being rolled up onto a wind-up shaft housed in the cross-member. (In FIGS. 1 and 2, the shaft is represented by axis 5.) Instead of being rolled up, the curtain could be folded up concertina-like. In which case, the curtain is raised by straps that are secured to the bottom of the curtain and that are themselves wound onto the wind-up shaft. It will be seen below that the invention is applicable in like manner thereto and that it then provides the same result.

Two examples of the curtain are shown in FIGS. 1 and 3.

The curtain of FIG. 1 is constituted by a transparent sheet 6 suitable for being rolled onto a shaft 5 in order to open the door-bay, or for being paid out from the shaft to close the door-bay. According to the invention, two strips 7 and 8 having a certain thickness (see FIG. 2) are formed on the curtain so that each of them is rolled onto itself while the curtain is being raised. The extra thickness may extend on the one side only, or it may extend on both sides, as shown in FIG. 2. When the curtain is rolled up, the faces of the curtain do not come into back-against-front contact, or they do so at some points only. In any event, they do not press against each other in the vicinity of the strips. As a result, the curtain surface is not damaged and the sheet constituting the curtain remains clearly transparent with the passage of time.

The extra thickness must be considerable. For example, for a curtain having a thickness of a few millimeters (2 mm to 5 mm), the extra thickness lies in the range 1 cm to 3 cm. The extra thickness also on the number of strips. It will be understood that the larger the number of strips, the less the extra thickness that is required.

An improvement is also obtained by installing horizontal separation strips. It would also be possible to implement horizontal separation strips using the stiffening members of a curtain.

Figure 5:
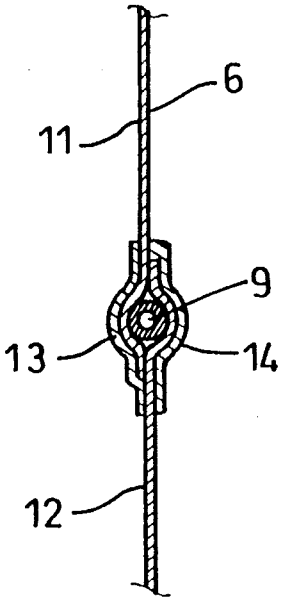

In FIG. 3, the curtain is reinforced and guided by reinforcing bars 9 whose ends are received in the slideways formed in the uprights 1 and 2. The curtain is made up of widths 11 and 12 (FIG. 5) that overlap to form a sheath that surrounds the bar 9. The individual widths 11 and 12 are transparent. To improve appearance and to provide reinforcement, opaque strips 13 and 14 are applied over both sides of the sheath.

Separation strip elements (or extra thicknesses) are disposed vertically (i.e. perpendicularly to the winding axis). In the example shown, the extra thickness is provided by a strip 15 of synthetic foam that is covered and held in position by a flexible plastic protective sheet 16 which is welded (or glued, or riveted, etc.) along the outside of the foam strip.

Figure 6:
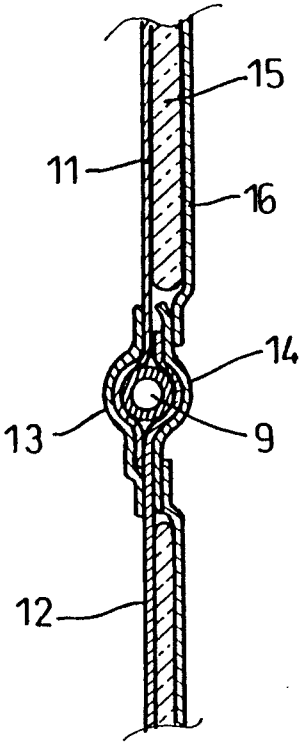
Figure 4:
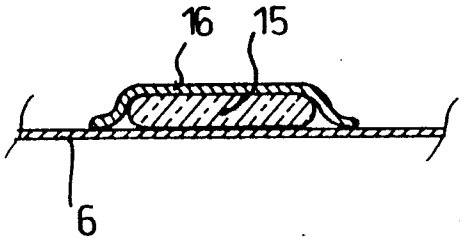

Because of the presence of the sheaths for the reinforcing bars, the separation strips are made up of segments that extend from one bar to the next (see FIG. 6). In this example, the ends of the protective plastic sheets are welded to the opaque strips 13 and 14 that cover the sheaths for the reinforcing bars.

In the embodiment of FIG. 3, the separation strips protect the surface of the curtain, and make the winding diameter more uniform, thereby reducing non-uniformities due to the presence of the bars (assuming that bars are present). Noise is thus reduced while the curtain is being raised or lowered. A door is obtained which continues to be transparent and which operates particularly quietly. It will be understood that the invention may also be applied to doors that are not transparent.

FIG. 7 shows, in section, the uprights 1 and 2 that form the slideways for the edges of the curtain. The uprights have slots 21 and 22 in their sides facing the door-bay and the edges of the slots are folded into the uprights so as to form slideways that flare inwardly.

The curtain has four separation strips, two of which lie on the edges of the curtain, while the other two are distributed across the width of the curtain. The separation strips 23 and 24 placed at the edges of the curtain may thus constitute swellings that serve to hold the edges of the curtains in the slideways. The number of strips used depends on the width of the curtain, and on the forces it is designed to withstand. The strips are preferably uniformly distributed across the width of the curtain, both for functional reasons and to improve appearance.

I claim:

1. A goods-handling door having a retractable curtain, the door comprising:

a flexible curtain that is rollable or foldable by means of a rotary winding shaft, wherein said curtain includes on at least one face of said curtain at least one flexible strip extending perpendicularly to the shaft and wherein said flexible strip provides excess thickness on the curtain to thereby define a separation strip such that when the curtain is rolled or folded, said strip rolls or folds onto itself, said flexible strip holds the layers of the curtain apart from one another when the curtain is in a retracted position.

2. The goods-handling door according to claim 1, wherein a plurality of parallel separation strips are provided in a direction perpendicular to said flexible strip.

3. The goods-handling door according to claim 2, wherein each of said parallel separation strips forms a stiffening component for the curtain.

4. The goods-handling door according to claim 1, wherein additional separation strips are provided on the edges of the curtain.

5. The goods-handling door according to claim 4, wherein said additional separation strips disposed on the edges of the curtain form means for retaining the edges of the curtain in respective slideways.

6. The goods-handling door according to claim 1, wherein said flexible strip is held in place by a sheet of plastic attached to the curtain along the edges of the flexible strip.

* * * * *